US005603227A

United States Patent [19]

Holden et al.

[11] Patent Number: 5,603,227

[45] Date of Patent: Feb. 18, 1997

[54] BACK PRESSURE CONTROL FOR IMPROVED SYSTEM OPERATIVE EFFICIENCY

[75] Inventors: Steven J. Holden, Manlius, N.Y.; John A. Schwoerer, Boston, Mass.

[73] Assignee: Carrier Corporation, Syracuse, N.Y.

[21] Appl. No.: 557,390

[22] Filed: Nov. 13, 1995

[51] Int. Cl.[6] ..... F25B 43/00

[52] U.S. Cl. ..... 62/193; 62/210; 62/470

[58] Field of Search ..... 62/192, 193, 190, 62/174, 209, 210, 468, 469, 470, 473, 474

[56] References Cited

U.S. PATENT DOCUMENTS

| | | | |
|---|---|---|---|
| 2,155,051 | 4/1939 | Kägi | 62/193 |
| 3,827,255 | 8/1974 | Kish | 62/468 X |
| 4,653,286 | 3/1987 | Huenniger | 62/174 |
| 5,134,856 | 8/1992 | Pillis et al. | 62/193 |
| 5,170,640 | 12/1992 | Heitmann et al. | 62/470 |

*Primary Examiner*—Harry B. Tanner

[57] ABSTRACT

A normally closed valve is located downstream of the oil separator to insure that sufficient oil pressure builds up to lubricate the compressor. The valve is responsive to the differential pressure between discharge and economizer such that throttling takes place over a limited portion of the operating envelope.

3 Claims, 2 Drawing Sheets

BACK PRESSURE CONTROL FOR IMPROVED SYSTEM OPERATIVE EFFICIENCY

BACKGROUND OF THE INVENTION

Commonly assigned U.S. Pat. No. 5,170,640 discloses an oil separator with a valve between the vortex oil separator and the coalescer. The valve is spring biased closed. The opening bias is provided by the differential pressure between compressor suction and discharge pressure which acts across the valve. Accordingly, the discharge pressure must build up to open the valve thereby insuring that a sufficient pressure is available to provide lubrication of the compressor prior to supplying refrigerant to the system. There is, therefore, a range of operating conditions over which the valve is closed or in a partially open position throttling the flow and reducing system operating efficiency.

SUMMARY OF THE INVENTION

The present invention uses the pressure differential between the discharge pressure and the economizer pressure, instead of the suction pressure, as the opening force opposing the spring bias. For economized compressor designs where certain bearings are at economizer pressure or at a pressure intermediate to suction and discharge or where there is oil injection to a compressor at an intermediate pressure, the minimum oil pressure requirement is more directly related to economizer pressure than suction pressure. For a given discharge-suction pressure difference, economizer pressure varies with unloader state, suction pressure, system or condenser subcooling, economizer effectiveness, system transients, and compressor manufacturing variations. Therefore, the present invention will throttle the compressor discharge flow and consequently reduce system efficiency over a smaller portion of the operating envelope than the U.S. Pat. No. 5,170,640 device, with the opening bias chosen to maintain the same minimum discharge-economizer pressure difference. As in the valve of U.S. Pat. No. 5,170,640, it is desirable to avoid valve chatter so that in both devices the valve is throttling only over a portion of the operating envelope and is fully open over the rest of the operating envelope.

It is an object of this invention to restrict back pressure in a chiller system oil separator.

It is another object of this invention to reduce the portion of a chiller operating envelope where a valve must restrict flow. These objects, and others as will become apparent hereinafter, are accomplished by the present invention.

Basically, a valve controlling flow through an oil separator into a refrigeration system has an opening bias determined by the differential pressure between discharge and economizer and throttling by the valve takes place over a reduced portion of the operating envelope.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
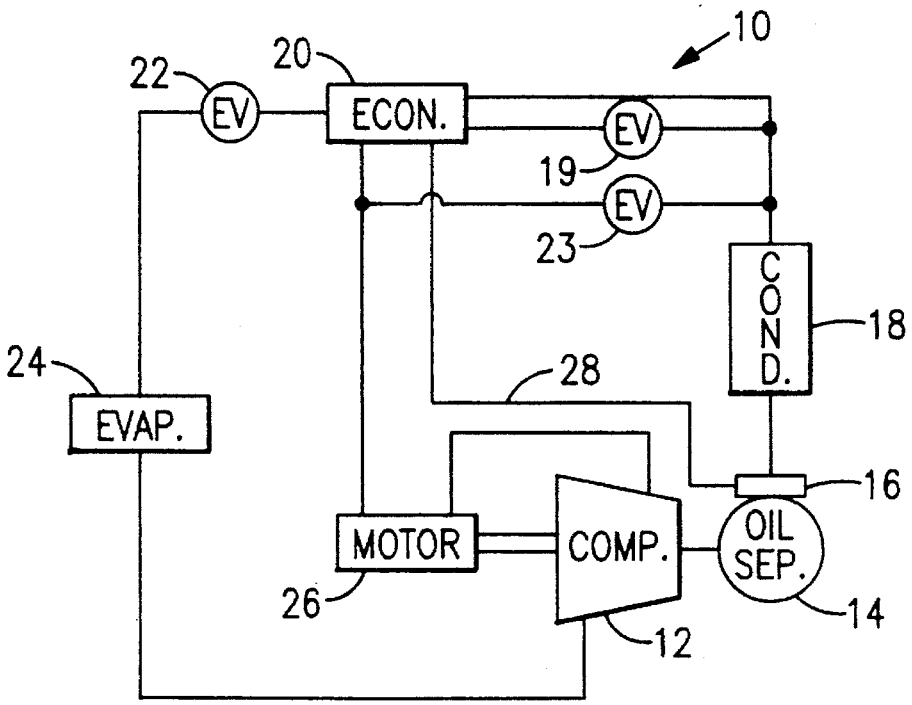
FIG. 1 is a schematic representation of a refrigeration system employing the present invention.

In FIG. 1, the numeral 10 generally designates a refrigeration system employing the present invention. Compressor 12 which is, typically, a screw compressor, but may be a scroll compressor, delivers high pressure, oil laden refrigerant gas to external oil separator 14. Valve 16 controls the flow of refrigerant gas through oil separator 14 to condenser 18. Liquid refrigerant passes from condenser 18 through expansion valve, EV, 19 to economizer 20 with a major portion of the refrigerant passing from economizer 20 serially through expansion valve 22 and evaporator 24 to the suction of compressor 12. Gaseous refrigerant, as saturated vapor, is supplied, typically, to compressor motor 26 to cool the motor and is then re-mixed into the compression process at mid stage pressure. Additionally, as will be explained in greater detail below, economizer 20 is connected to valve 16 via line 28 thereby providing a fluid pressure force on valve 16 corresponding to economizer pressure. Valve 23 permits bypassing economizer 20 to cool motor 26 with additional liquid refrigerant. Economizer 20 may be a flash tank economizer or a heat exchanger economizer.

Figure 2:
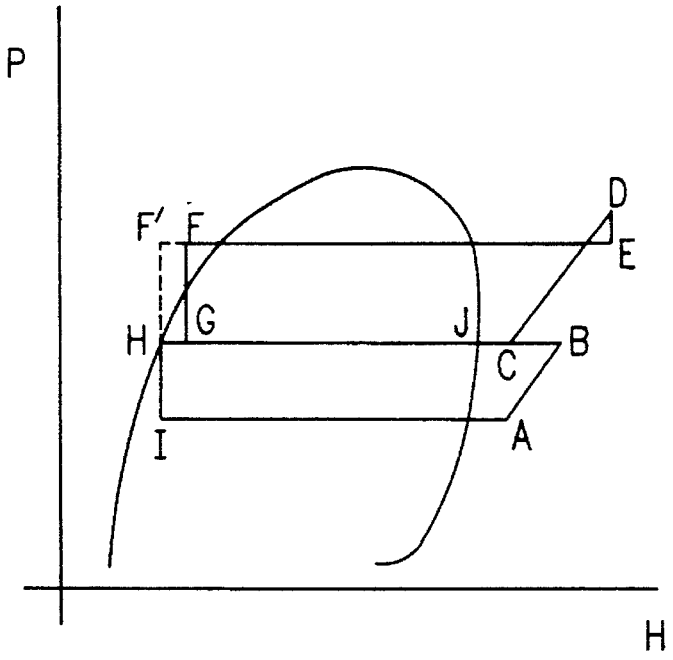
FIG. 2 is a pressure vs. enthalpy diagram for the FIG. 1 system.

In FIG. 2, the point A represents the suction of compressor 12 and the line A-B represents the first stage of compression and B-C-J represents both the cooling of the motor 26 by the economizer flow and the mixing process where the economizer flow is reintroduced into the rotors of compressor 12. This is shown as a constant pressure process for simplicity, although the pressure would increase during the mixing process for a screw compressor with an economizer side port. Line C-D represents the second stage of the compression process with D representing the outlet of compressor 12. Line D-E represents the passage of the discharge gas through the oil separator 14 and valve 16. Line E-F represents the passage of the discharge gas through condenser 18. Line F-G represents expansion through valve 19. Economizer 20 delivers saturated liquid at H and saturated vapor at J. Line H-I represents expansion through valve 22. Alternatively, this could be accomplished by a heat exchanger, as an adiabatic flash tank provides the same reduction in enthalpy entering the condenser as a heat exchanger having 100% effectiveness. If a heat exchanger economizer having 100% effectiveness were used, the liquid exiting the heat exchanger would be subcooled to F', and the expansion through valve 22 would be represented by line F'-I. For conditions where additional cooling of the motor 26 or compressor 12 is required, additional liquid is expanded through valve 23 along line F-G, which moves point J into the 2-phase region. Line J-C represents both the gas picking up heat as it flows over the motor 26 and the re-mixing into the compression process.

Figure 3:
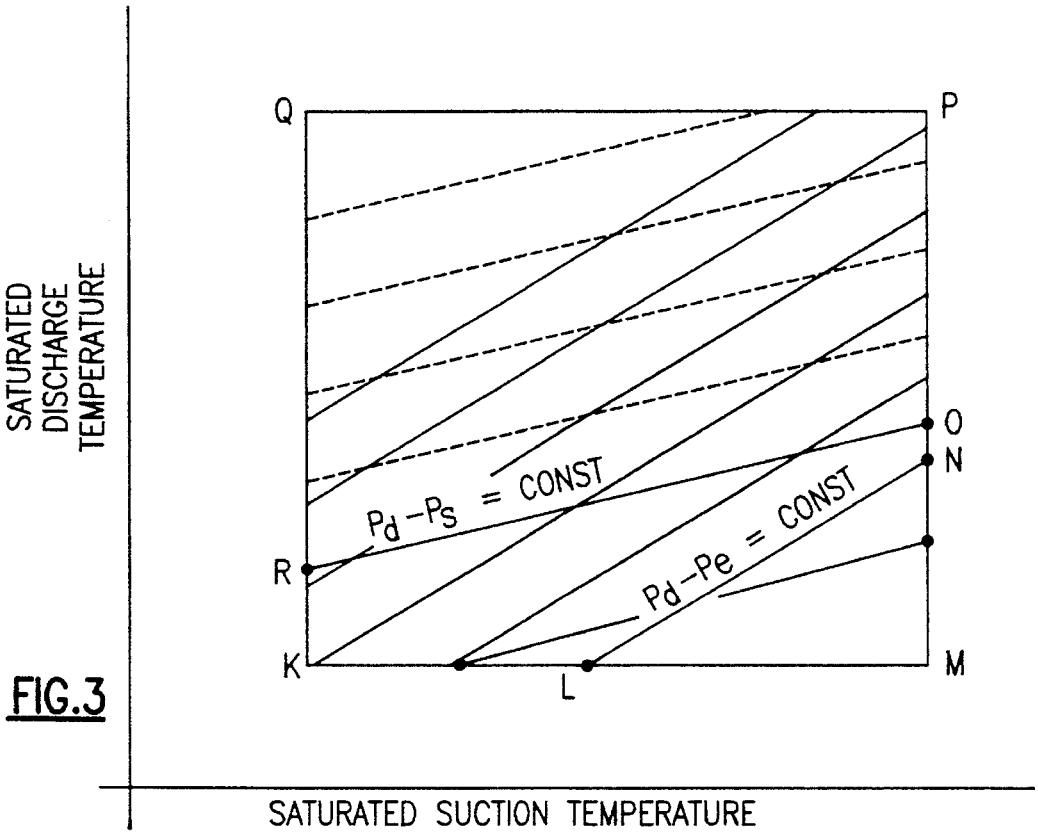
FIG. 3 is a diagram showing an exemplary operating envelope for the compressor of the FIG. 1 system.

In FIG. 3, the points K through R define an exemplary operating envelope for compressor 12. As noted above, the valve of the U.S. Pat. No. 5,170,640 device is opened by the differential pressure between suction and discharge overcoming the spring bias, and the area defined by points K-M-O-R represents the portion of the operating envelope where throttling occurs due to the presence of the valve controlling flow through the oil separator. This throttling represents a system loss.

Figure 4:
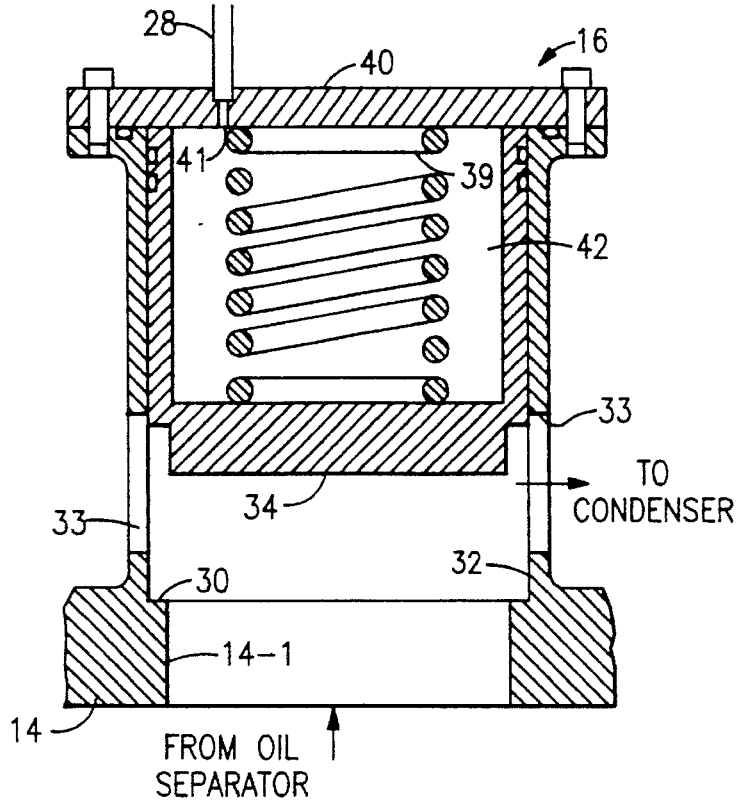
FIG. 4 is an enlarged view of the valve of the FIG. 1 system in its open position.

Referring now to FIGS. 1 and 4, valve 16 may be located within the oil separator 14 as in the U.S. Pat. No. 5,170,640 device where the valve is located between the vortex separator and the coalescer. As illustrated, valve 16 coacts with the outlet port 14-1 of oil separator 14 to control the flow of refrigerant through oil separator 14 into the refrigeration system 10. Port 14-1 is separated from integral piston bore 32 by annular valve seat 30 which serves as the valve seat for hollow differential piston valve member 34. Piston bore 32 is closed at one end by plate 40 and has radial ports 33 which are fluidly connected to condenser 18. Spring 39 is located in chamber 42 and provides a seating bias to differential piston valve member 34 of a value equal to a desired relative pressure acting on the oil sump in oil separator 14. Port 41 in plate 40 together with line 28 provides fluid communication between the flash tank of economizer 20 and chamber 42. In the case of a heat exchanger economizer, line 28 would be connected to the outlet of the heat exchanger which is connected to the compressor economizer port and is at economizer pressure.

At start up, spring 39 will tend to bias differential piston valve member 34 onto its seat 30 thereby blocking flow between oil separator 14 and condenser 18. Because chamber 42 is connected to the economizer 20, pressure will build up as the system 10 comes to operating equilibrium. With the discharge of the compressor 12 being supplied to oil separator 14, the pressure will rapidly build up at port 14-1 and act on differential piston valve member 34 against the bias of spring 39 causing it to open. The bias of spring 39 will insure a sufficient pressure in the oil separator 14 before valve member 34 of valve 16 opens. Chamber 42 is at economizer pressure so that the differential pressure, $P_d$–$P_e$, depends upon economizer pressure as well as discharge pressure. Since economizer pressure is more variable over the operating envelope than suction and discharge pressure, the differential pressure opposing the bias of spring 39 is able to fully open valve 16 over a larger portion of the operating envelope. Referring specifically to FIG. 3, the present invention, using the economizer pressure rather than the suction pressure as a component of the differential pressure, produces modulation over the portion of the operating envelope defined by L-M-N-L. This results in the portion of the operating envelope defined by K-L- N-O-R-K free of throttling and the attendant losses that would be present if suction pressure was used instead of economizer pressure. Point N is generally at a lower saturated discharge than point O because point O must be chosen for the worst-case economizer pressure, i.e. fully loaded, zero system subcooling, 100% economizer effectiveness, worst-case system transients, and worst-case compressor manufacturing variations. The slope of line L-N of constant discharge-economizer pressure difference, $P_d$–$P_e$= constant, is steeper than that of line R–O, of constant discharge-suction pressure difference, $P_d$–$P_s$=constant, for a given state of compressor loading, system subcooling, and economizer effectiveness.

Although a preferred embodiment of the present invention has been illustrated and described, other changes will occur to those skilled in the art. For example, the valve 16 may be located in the oil separator or downstream thereof. It is therefore intended that the present invention is to be limited only by the scope of the appended claims.

What is claimed is:

1. In a closed refrigeration system having an operating envelope and serially including a compressor, an oil separator, a normally closed valve, a condenser, an economizer means and an evaporator means, valve control means comprising:

said normally closed valve being fluidly connected to said economizer means whereby economizer pressure tends to bias said valve closed;

compressor discharge pressure acting on said normally closed valve so as to provide an opening bias thereto, whereby said valve provides a throttling of flow through said valve over a limited portion of said operating envelope and is fully open over the remainder of said operating envelope.

2. The refrigeration system of claim 1 wherein said economizer means is a flash tank economizer.

3. The refrigeration system of claim 1 wherein said economizer means is a heat exchanger economizer.

* * * * *